US008062049B2

(12) United States Patent
Tobey

(10) Patent No.: US 8,062,049 B2
(45) Date of Patent: Nov. 22, 2011

(54) LATCH ASSEMBLY FOR A CONNECTOR ASSEMBLY

(75) Inventor: Shawn Phillip Tobey, Trinity, NC (US)

(73) Assignee: Tyco Electronics Corporation, Berwyn, PA (US)

( * ) Notice: Subject to any disclaimer, the term of this patent is extended or adjusted under 35 U.S.C. 154(b) by 0 days.

(21) Appl. No.: 12/688,284

(22) Filed: Jan. 15, 2010

(65) Prior Publication Data

US 2011/0177710 A1 Jul. 21, 2011

(51) Int. Cl.
*H01R 4/50* (2006.01)

(52) U.S. Cl. ..... 439/345

(58) Field of Classification Search ..... 439/345, 439/540.1

See application file for complete search history.

(56) References Cited

U.S. PATENT DOCUMENTS

| | | | | |
|---|---|---|---|---|
| 3,874,763 | A * | 4/1975 | Hoover | 439/345 |
| 4,273,403 | A * | 6/1981 | Cairns | 439/345 |
| 4,597,627 | A | 7/1986 | Wondra et al. | |
| 5,178,552 | A * | 1/1993 | Jinno et al. | 439/140 |
| 5,639,261 | A | 6/1997 | Rutkowski et al. | |
| 5,647,765 | A | 7/1997 | Haas et al. | |
| 5,735,712 | A | 4/1998 | Haas et al. | |
| 5,791,930 | A * | 8/1998 | Tabata et al. | 439/345 |
| 5,895,292 | A | 4/1999 | Affeltranger | |
| 6,024,498 | A * | 2/2000 | Carlisle et al. | 385/56 |
| 6,066,001 | A | 5/2000 | Liptak et al. | |
| 6,074,251 | A | 6/2000 | Edgerly et al. | |
| 6,227,911 | B1 | 5/2001 | Boutros et al. | |
| 6,269,008 | B1 | 7/2001 | Hsu | |
| 6,346,002 | B1 * | 2/2002 | Hsu et al. | 439/358 |
| 6,386,918 | B1 * | 5/2002 | Zheng et al. | 439/607.45 |
| 6,506,070 | B1 * | 1/2003 | Huang | 439/352 |
| 6,540,564 | B1 | 4/2003 | Ko | |
| 6,655,988 | B1 | 12/2003 | Simmons et al. | |
| 6,780,035 | B2 | 8/2004 | Bohbot | |
| 6,799,898 | B2 * | 10/2004 | Cheng et al. | 385/56 |
| 6,802,735 | B2 | 10/2004 | Pepe et al. | |
| 6,976,867 | B2 | 12/2005 | Navarro et al. | |
| 7,033,210 | B1 | 4/2006 | Laurer et al. | |
| 7,077,707 | B2 | 7/2006 | Hyland et al. | |
| 7,320,613 | B1 * | 1/2008 | Ratzlaff | 439/345 |
| 7,357,675 | B2 | 4/2008 | Barringer et al. | |

(Continued)

FOREIGN PATENT DOCUMENTS

EP 0037013 A2 10/1981

(Continued)

OTHER PUBLICATIONS

European Search Report, European Application No. 11 15 1023, European Filing Date Jan. 14, 2011.

(Continued)

*Primary Examiner* — Tulsidas C Patel
*Assistant Examiner* — Vladimir Imas

(57) ABSTRACT

A connector assembly for mating with a multi-port electrical connector includes a shielded housing having a plurality of discrete shielded plug chambers and a plurality of plugs received in corresponding plug chambers. Each of the plugs are shielded from one another by the shielded housing, and the plugs are configured for simultaneous mating with the multi-port electrical connector, wherein each plug is received in a different port of the electrical connector. The connector assembly also includes a latch assembly coupled to the shielded housing. The latch assembly engages the shielded housing and is configured to engage the multi-port electrical connector to electrically common the shielded housing and the multi-port electrical connector.

23 Claims, 8 Drawing Sheets

U.S. PATENT DOCUMENTS

| | | | | |
|---|---|---|---|---|
| 7,601,019 | B2 * | 10/2009 | Hsieh et al. | 439/345 |
| 7,699,639 | B2 * | 4/2010 | Sun | 439/345 |
| 2002/0028604 | A1 | 3/2002 | Lo et al. | |
| 2004/0229501 | A1 | 11/2004 | Caveney et al. | |
| 2004/0246693 | A1 | 12/2004 | Lloyd et al. | |
| 2005/0136747 | A1 | 6/2005 | Caveney et al. | |
| 2005/0164548 | A1 | 7/2005 | Spears et al. | |
| 2005/0282432 | A1 | 12/2005 | Murr et al. | |
| 2008/0064250 | A1 * | 3/2008 | Lee et al. | 439/352 |
| 2008/0194133 | A1 * | 8/2008 | Kramer | 439/345 |
| 2008/0248677 | A1 * | 10/2008 | Furio et al. | 439/345 |
| 2008/0299811 | A1 * | 12/2008 | Battista | 439/345 |
| 2009/0023323 | A1 * | 1/2009 | Lin et al. | 439/345 |
| 2009/0156046 | A1 * | 6/2009 | Chen et al. | 439/345 |
| 2009/0291584 | A1 * | 11/2009 | Wu | 439/345 |
| 2010/0029125 | A1 * | 2/2010 | Sun | 439/345 |
| 2010/0041257 | A1 * | 2/2010 | Beck et al. | 439/108 |
| 2010/0075526 | A1 * | 3/2010 | Chiu et al. | 439/345 |
| 2010/0123455 | A1 * | 5/2010 | Tarchinski et al. | 324/149 |
| 2010/0194119 | A1 * | 8/2010 | Ishigami et al. | 292/128 |
| 2010/0221939 | A1 * | 9/2010 | Fakhri et al. | 439/153 |

FOREIGN PATENT DOCUMENTS

| | | | |
|---|---|---|---|
| EP | 0 809 3331 | A1 | 11/1997 |
| WO | WO 00/44070 | A2 | 7/2000 |

OTHER PUBLICATIONS

AMP-Twist 7AS 4p Plug Stranded Cable; C-1711498; 1 pg., 2008.
AMP-Twist 7AS 4p Plug Solid Cable; C-1711556; 1 pg., 2008.

* cited by examiner

LATCH ASSEMBLY FOR A CONNECTOR ASSEMBLY

BACKGROUND OF THE INVENTION

The subject matter herein relates generally to data communication systems, and more particularly, to connector assemblies for data communication systems.

Data communication systems have many applications, including telecommunications and interconnecting computers over local area networks. Application demands are driving systems to have increased electrical performance while increasing the density of connectivity. Some known systems strive to maximize the number of contact pairs within a connector to make installation orderly and efficient. However, such systems are not without disadvantages. For instance, with increased numbers of contact pairs, and as products become denser, known systems and connectors are challenged to perform wire termination and assemble the connectors. Difficulties arise in achieving desired electrical transmission performance due to interference and signal degradation, such as from cross-talk between contact pairs. While some systems attempt to provide electrical isolation between components by surrounding them with materials that effectively provide shielding from cross-talk, providing such shielding in a limited space while maintaining an acceptable termination and assembly process has proven problematic.

Additionally, known systems suffer from problems with accessibility for installation and removal within the system. For example, some known systems include a telecommunications rack or cabinet with panels arranged in a stacked configuration. The space between neighboring connector assemblies connected to the panels is limited. Many high density connector assemblies use screw fasteners to retain the connector assemblies to the panel because of the limited space. However, such systems require a tool, such as a screwdriver, to install and remove the connector assemblies, which increases the installation and removal time.

A need remains for a communication system that achieves high transfer rates with desirable system performance and space utilization. A need remains for a connector assembly that may by quickly installed and removed without the need for tools.

BRIEF DESCRIPTION OF THE INVENTION

In one embodiment, a connector assembly for mating with a multi-port electrical connector is provided including a shielded housing having a plurality of discrete shielded plug chambers and a plurality of plugs received in corresponding plug chambers. Each of the plugs is shielded from one another by the shielded housing, and the plugs are configured for simultaneous mating with the multi-port electrical connector, wherein each plug is received in a different port of the electrical connector. The connector assembly also includes a latch assembly coupled to the shielded housing. The latch assembly engages the shielded housing and is configured to engage the multi-port electrical connector to electrically common the shielded housing and the multi-port electrical connector.

In another embodiment, a connector assembly is provided for mating with a multi-port electrical connector. The connector assembly includes a shielded housing having a plurality of discrete shielded plug chambers. The shielded housing also has a mating end and a cable end with sides extending between the mating end and the cable end. A plurality of plugs are received in corresponding plug chambers, where the plugs are shielded from one another by the shielded housing. The plugs are configured for simultaneous mating with the multi-port electrical connector, wherein each plug is received in a different port of the electrical connector. The connector assembly also includes a latch assembly arranged along at least one of the sides of the shielded housing. The latch assembly has a spring latch configured to engage the electrical connector to secure the connector assembly to the electrical connector when the spring latch is in a latched position. The latch assembly also has a lever arm engaging the spring latch, where the lever arm is actuated to move the spring latch to an unlatched position. The lever arm is exposed at the cable end for actuation.

In a further embodiment, a connector assembly for mating with a multi-port electrical connector is provided that includes a shielded housing having a plurality of discrete shielded plug chambers and a plurality of plugs received in corresponding plug chambers. Each of the plugs are shielded from one another by the shielded housing. The plugs are configured for simultaneous mating with the multi-port electrical connector, wherein each plug is received in a different port of the electrical connector. The connector assembly also includes a latch assembly arranged along at least one of the sides of the shielded housing. The latch assembly has a spring latch configured to engage the electrical connector to secure the connector assembly to the electrical connector when the spring latch is in a latched position. The latch assembly also has a lever arm engaging the spring latch, which is actuated to move the spring latch to an unlatched position. The latch assembly also has a lever lock movable between a locked position and an unlocked position. The lever lock locks the lever arm in place relative to the spring latch in the locked position. The lever arm is movable when the lever lock is in the unlocked position to allow the lever arm to move the spring latch to the unlatched position.

DETAILED DESCRIPTION OF THE INVENTION

Figure 1:
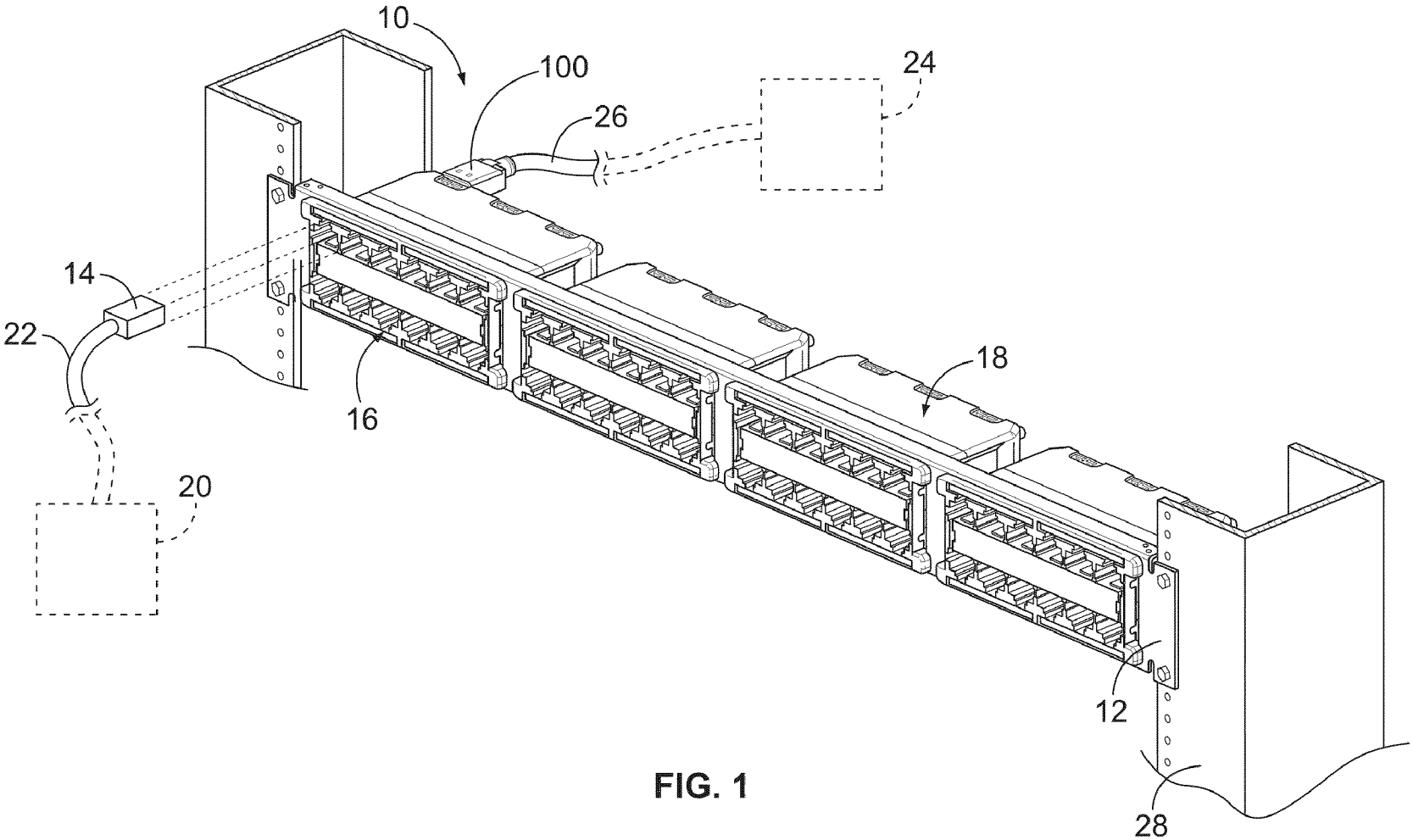
FIG. 1 is a front perspective view of a portion of a cable interconnect system illustrating a panel and a plurality of cassettes mounted to the panel.

FIG. 1 is a front perspective view of a portion of a cable interconnect system 10 illustrating a panel 12 and a plurality of cassettes 18 mounted to the panel 12. FIG. 1 also illustrates a modular plug 14 connected to one of the cassettes 18. The cassette 18 comprises an array of receptacles 16 for accepting or receiving the modular plug 14. The cassette 18 represents a multi-port electrical connector, and may be referred to hereinafter as multi-port electrical connector 18 or electrical connector 18.

The cable interconnect system 10 is utilized to interconnect various equipment, components and/or devices to one another. FIG. 1 schematically illustrates a first device 20 connected to the cassette 18 via a cable 22. The modular plug 14 is attached to the end of the cable 22. FIG. 1 also illustrates a second device 24 connected to the cassette 18 via a cable 26, such as a multi-pair cable having multiple wire pairs. A multi-plug connector assembly 100 is provided at the end of each cable 26, which is connected to a back end of the cassette 18.

The cassette 18 interconnects the first and second devices 20, 24. In an exemplary embodiment, the first device 20 may be a computer located remote from the cassette 18. The second device 24 may be a network switch. The second device 24 may be located in the vicinity of the cassette 18, such as in the same equipment room, or alternatively, may be located remote from the cassette 18. The cable interconnect system 10 may include a support structure 28, a portion of which is illustrated in FIG. 1, for supporting the panel 12 and the cassettes 18. For example, the support structure 28 may be an equipment rack of a network system. The panel 12 may be a patch panel that is mounted to the equipment rack. In a typical system, multiple panels 12 may be stacked within the support structure 28. The panels 12 may be sized to fit a standard rack specification, such as that defined in EIA-310. For example, the panels 12 may have a one rack unit height, or 1U height, of 1.75 inches. In alternative embodiments, rather than a patch panel, the panel 12 may be another type of network component used with a network system that supports cassettes 18 and/or other connector assemblies, such as interface modules, stacked jacks, or other individual modular jacks. For example, the panel 12 may be a wall or other structural element of a component. It is noted that the cable interconnect system 10 illustrated in FIG. 1 is merely illustrative of an exemplary system/component for interconnecting communication cables using modular jacks and modular plugs or other types of connectors. Optionally, the second device 24 may be mounted to the support structure 28.

Figure 2:
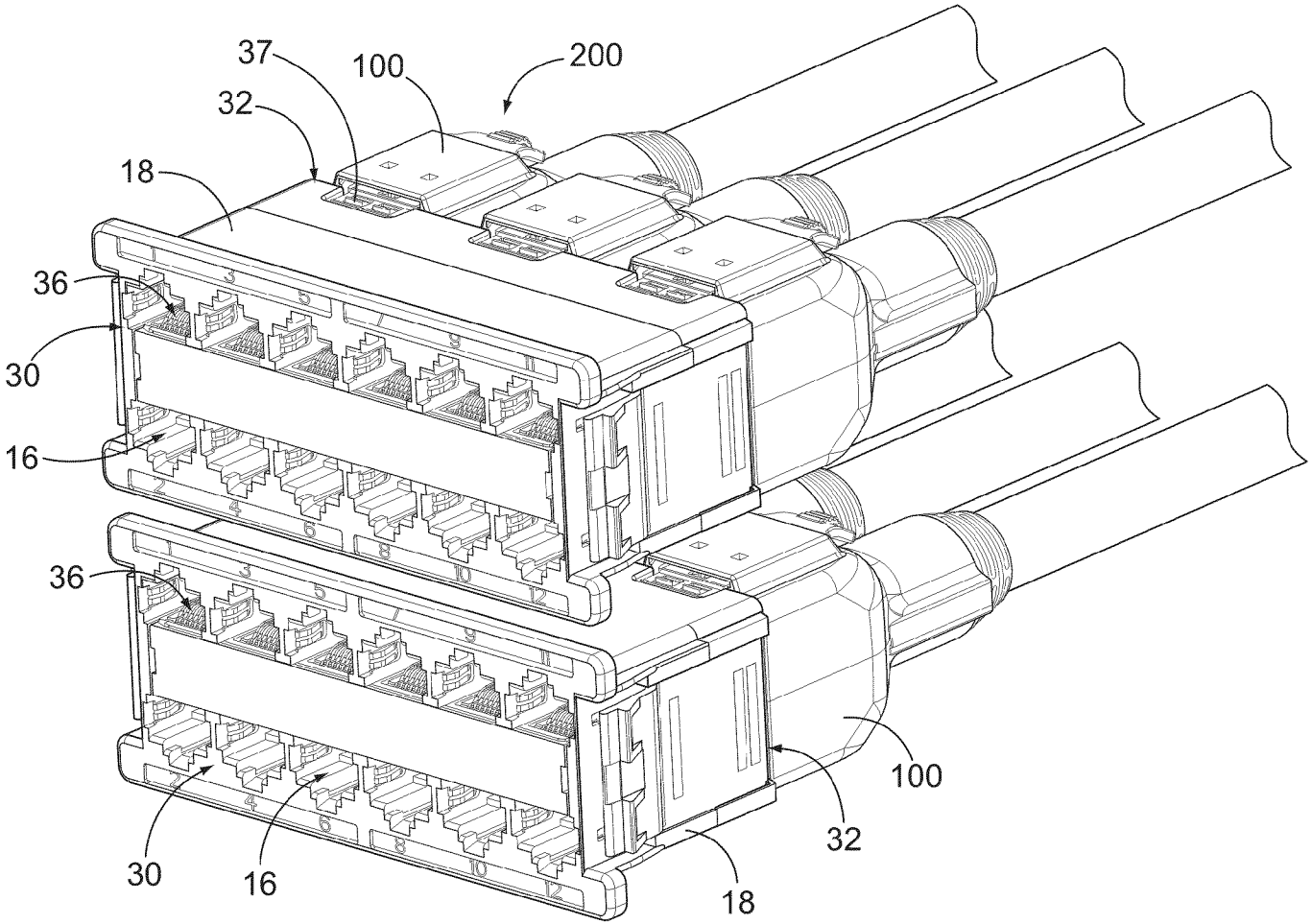
FIG. 2 is a front perspective view of a plurality of stacked cassettes with the corresponding panels removed illustrating a plurality of multi-plug connector assemblies mated with the cassettes.

FIG. 2 is a front perspective view of a plurality of stacked cassettes 18 with the corresponding panels 12 (shown in FIG. 1) removed illustrating a plurality of multi-plug connector assemblies 100 mated with the cassettes 18. The cassettes 18 may be substantially similar to the cassettes described in U.S. patent application Ser. No. 12/394,987, Titled SHIELDED CASSETTE FOR A CABLE INTERCONNECT SYSTEM, the complete subject matter of which is hereby incorporated by reference in its entirety.

The cassette 18 includes a front mating interface 30 and a rear mating interface 32. The modular plugs 14 (shown in FIG. 1) are mated with the cassettes 18 at the front mating interface 30. The multi-plug connector assemblies 100 are mated with the cassettes 18 at the rear mating interface 32. The cassette 18 includes a plurality of receptacles 16 open at the front mating interface 30 for receiving the modular plugs 14. In an exemplary embodiment, the receptacles 16 are arranged in a stacked configuration in a first row and a second row. A plurality of receptacles 16 are arranged in each of the first and second rows. In the illustrated embodiment, six receptacles 16 are arranged in each of the first and second rows, thus providing a total of twelve receptacles 16 in each cassette 18. It is realized that the cassettes 18 may have more or less than twelve receptacles 16 arranged in more or less than two rows.

Communication modules 36 are held within the cassette 18 for interfacing with the modular plugs 14 and the multi-plug connector assemblies 100. The communication modules 36 are exposed within the receptacles 16 for mating with the modular plugs. The communication modules 36 also extend to the rear mating interface 32 for interfacing with the connector assemblies 100. Data is transferred by the communication modules 36 between the modular plugs 14 and the corresponding connector assemblies 100. Each multi-plug connector assembly 100 may be electrically connected to more than one communication module 36. For example, each connector assembly 100 is electrically connected to four communication modules 36, and thus communicate with four different modular plugs 14. In the illustrated embodiment, the communication modules 36 are configured to mate with an 8 position, 8 contact (8P8C) type of plug, such as an RJ-45 plug or another copper-based modular plug type of connector at the front mating interface 30. Alternatively, the communication modules 36 may be configured to mate with different types of plugs, such as other copper based types of plugs (e.g. a quad-plug) or fiber-optic types of plugs. The communication modules 36 are configured to mate with a different type of plug at the rear mating interface 32, however the mating interfaces at the front and rear of the communication modules 36 may be the same in some alternative embodiments.

The connector assemblies 100 each have latch assemblies 200 that securely couple the connector assemblies 100 to the cassettes 18. Notably, the cassettes 18 include catches 37 that interact with the latch assemblies 200 to secure the connector assemblies 100 to the cassettes 18. The latch assemblies 200 may be unlatched to remove the connector assemblies 100 from the cassettes 18. In an exemplary embodiment, the latch assemblies 200 electrically common the cassettes 18 and the connector assemblies 100. When electrically commoned, the cassettes 18 and the connector assemblies 100 are at the same electrical potential. Optionally, the latch assemblies 200 create a ground path between the connector assemblies and the cassettes 18, such as when the cassettes 18 are grounded, such as to earth ground or chassis ground.

Figure 3:
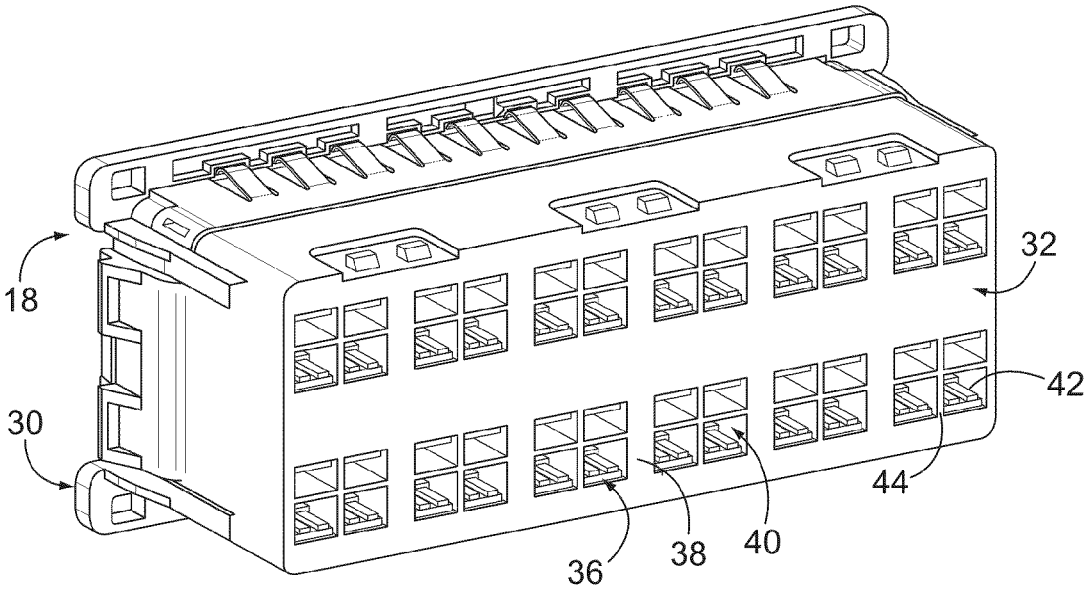
FIG. 3 is a rear perspective view of one of the cassettes.

FIG. 3 is a rear perspective view of one of the cassettes 18 illustrating the rear mating interface 32 and a portion of the communication modules 36 at the rear mating interface 32. The communication modules 36 are illustrated more fully in FIG. 4. The communication modules 36 are configured to be directly electrically connected to the connector assemblies 100 (shown in FIGS. 1 and 2). The cassette 18 includes a plurality of interior walls 38 that define different plug cavities 40 at the rear mating interface 32. The interior walls 38 define shield elements between adjacent plug cavities 40 that provide shielding between the communication modules 36 received in the corresponding plug cavities 40. The walls 38 may extend at least partially between the front and the rear of the cassette 18 and the walls 38 may also define the receptacles 16 (shown in FIG. 2) at the front mating interface 30.

In the illustrated embodiment, the communication modules 36 at the rear mating interface 32 represent a quad-type mating interface configured to receive a quad-type plug connector therein. The communication modules 36 each include contacts 42. The contacts 42 are arranged in pairs in different quadrants of the plug cavities 40. Wall segments 44 divide the plug cavities 40 into quadrants, with each quadrant receiving a pair of the contacts 42. Optionally, the wall segments 44 may provide shielding from adjacent quadrants.

Figure 4:
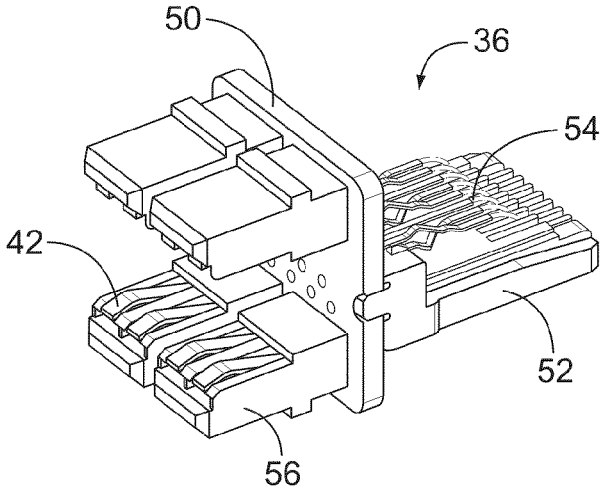
FIG. 4 illustrates an exemplary communication module for use with the cassette shown in FIGS. 1-3.

FIG. 4 illustrates the communication module 36. The communication module 36 includes a circuit board 50, a contact support 52, and a plurality of contacts 54 arranged as a contact set. The contact support 52 and the contacts 54 extend from a front side of the circuit board 50. In the illustrated embodiment, the contact support 52 and the contacts 54 define a mating interface configured to mate with an RJ-45 type plug.

The communication module 36 includes a plurality of support towers 56 mounted to, and extending from, a rear side of the circuit board 50. The support towers 56 hold the contacts 42. Each of the contacts 42 are electrically connected to corresponding ones of the contacts 54 via the circuit board 50. The arrangement of the contacts 42 is different from the contacts 54. For example, the contacts 54 are arranged in a single row, whereas the contacts 42 are arranged in pairs in quadrants. The communication module 36, including the circuit board 50, is received within a corresponding shielded channel of the cassette 18 (shown in FIG. 3). The communication module 36 is isolated from other communication modules 36 by the shielded channels. For example, the interior wall segments 44 (shown in FIG. 3) separate adjacent communication modules 36 from one another.

Figure 5:
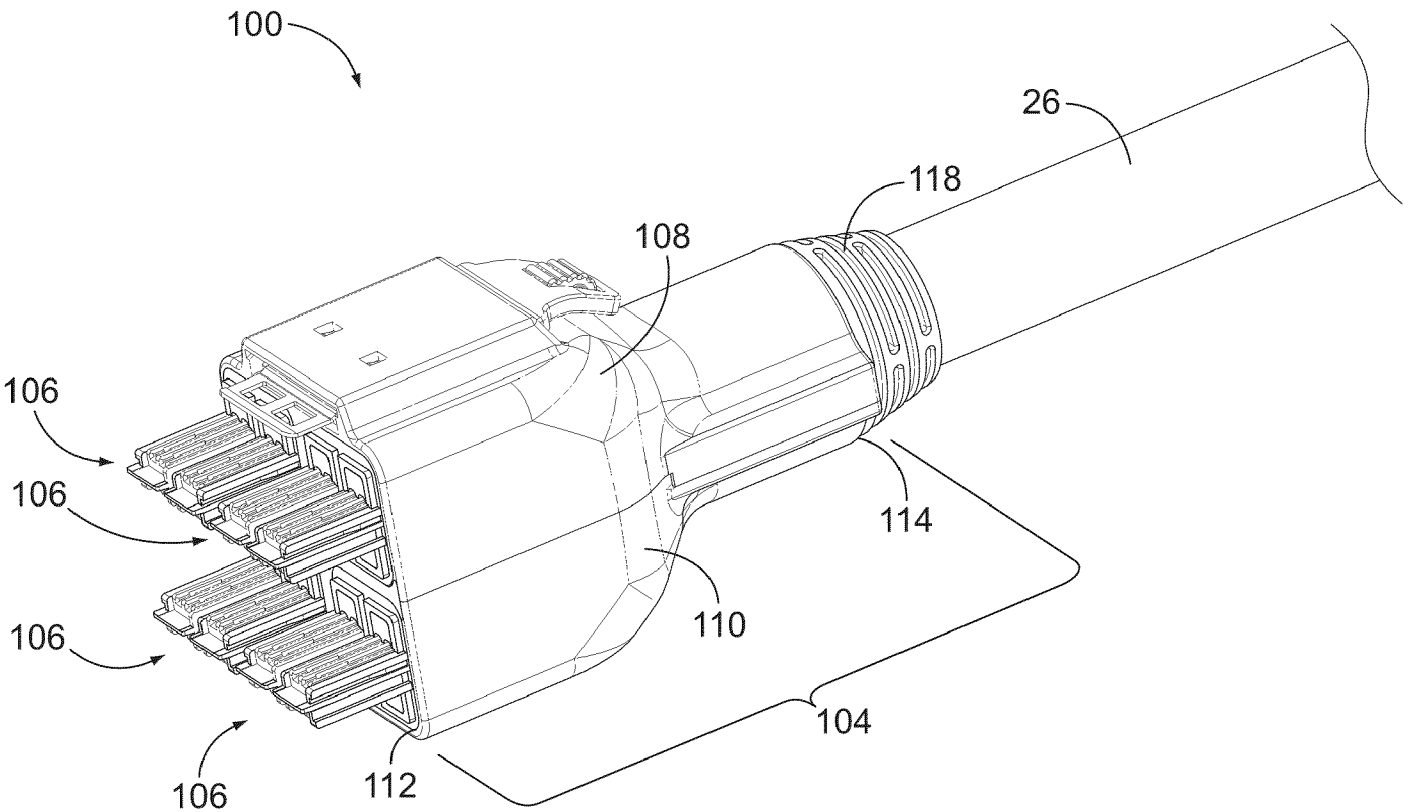
FIG. 5 is a front perspective view of an exemplary connector assembly for mating with the cassette shown in FIGS. 1-3.

FIG. 5 is a front perspective view of an exemplary connector assembly 100 for mating with the cassette 18 (shown in FIGS. 1-3). The connector assembly 100 is terminated to an end of the cable 26. The cable 26 is a multi-pair cable having multiple wire pairs that are terminated to corresponding terminals 102, which mate with the contacts 42 of the communication module 36 (both shown in FIG. 3). The connector assembly 100 includes a shielded housing 104 which holds a plurality of individual and discrete plugs 106. Each plug 106 is configured to mate with a corresponding communication module 36. As such, when the connector assembly 100 is mated to the cassette 18 (shown in FIGS. 1-3), multiple plugs 106 are simultaneously mated with corresponding communication modules 36.

The shielded housing 104 includes an upper shell 108 and a lower shell 110 coupled together. The shielded housing 104 extends between a mating end 112 and a cable end 114. The cable 26 passes into the shielded housing 104 through a boss 116 at the cable end 114. The boss 116 provides strain relief for the cable 26. Optionally, a ferrule 118 may be provided at the cable end 114 to provide strain relief for the cable 26.

Figure 6:
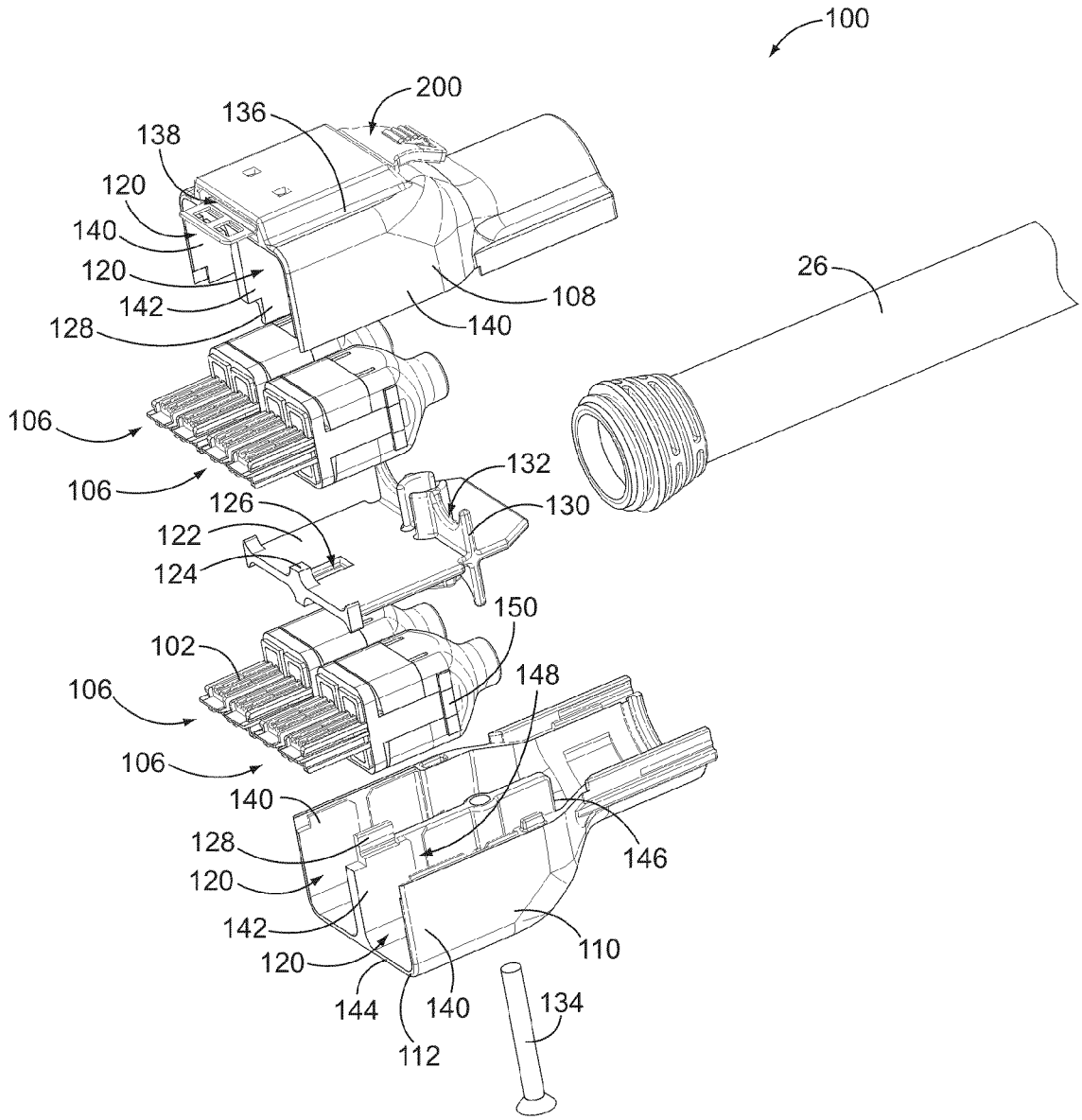
FIG. 6 is an exploded view of the connector assembly shown in FIG. 5.

FIG. 6 is an exploded view of the connector assembly 100 showing the individual plugs 106. Optionally, the plugs 106 may be similar to the plugs described in copending U.S. patent Application filed on the same day, having docket number NT-00318 (958-1572) and titled "PLUG ASSEMBLY", the complete subject matter of which is incorporated herein by reference in its entirety. The plugs 106 are separate from one another and are individually terminated to corresponding wires (not shown) of the cable 26. Optionally, each plug 106 may be terminated to multiple wire pairs extending from the cable 26. For example, in one exemplary embodiment, each plug 106 is terminated to four wire pairs, or eight wires. Once the plugs 106 are terminated to the wires, the connector assembly 100 may be assembled.

During assembly, the plugs 106 are loaded into the shielded housing 104. The shielded housing 104 is fabricated from a metal material, such as an aluminum or aluminum alloy, and thus provides shielding for the plugs 106. In an exemplary embodiment, the plugs 106 are loaded into separate plug chambers 120 that are defined by the shielded housing 104. As such, the individual plugs 106 are shielded from one another to reduce or prevent cross-talk.

In the illustrated embodiment, the upper shell 108 includes two upper plug chambers 120 and the lower shell 110 includes two lower plug chambers 120. As such, four individual plugs 106 are provided within the connector assembly 100, defining a quad connector assembly 100. However, it is realized that any number of plug chambers 120 may be defined by the upper shell 108 and/or the lower shell 110. Optionally, the upper shell 108 and/or the lower shell 110 may each only have one plug chamber 120. It is also realized that the designation of upper and lower may be different if the connector assembly 100 were rotated 90°, such as to a left/right designation rather than an upper/lower designation.

The shielded housing 104 includes a center plate 122 between the upper and lower shells 108, 110. The center plate 122 is captured between the upper and lower shells 108, 110 when the connector assembly 100 is assembled. The center plate 122 separates the upper and lower plug chambers 120. The center plate 122 is fabricated from a metal material, such as an aluminum or aluminum alloy, and thus provides shielding for the plug chambers 120. The center plate 122 includes supporting features 124 that support the individual plugs 106 and hold the plugs 106 in the shielded housing 104. The supporting features 124 engage select portions of the plugs 106 to electrically common the shielded housing 104 and the plugs 106. When electrically commoned, the plugs 106 and the shielded housing 104 are at the same electrical potential.

In an exemplary embodiment, the center plate 122 includes one or more opening(s) 126 therethrough. Fingers 128 of the upper and lower shells 108, 110 extend into and through the opening 126 to engage one another. The fingers 128 electrically common the upper and lower shells 108, 110 to one another. When electrically commoned, the upper and lower shells 108, 110 are at the same electrical potential. The fingers 128 may engage the center plate 122 to electrically common the upper and lower shells 108, 110 to the center plate 122. When electrically commoned, the upper and lower shells 108, 110 and the center plate 122 are at the same electrical potential. Other portions of the center plate 122 may also engage the upper and lower shells 108, 110 to electrically common the center plate 122 with the upper and lower shells 108, 110.

The center plate 122 includes flanges 130 that extend both upward and downward therefrom. The flanges 130 are positioned near the back ends of the plugs 106 when the connector assembly 100 is assembled and provide shielding behind the plugs 106. The flanges 130 include cut-outs 132 for the wires and/or the extreme back end of the plugs 106 to pass through.

A fastener 134 is used to securely couple the upper and lower shells 108, 110 together, and the fastener 134 extends through the center plate 122. Other types of securing means or features may be used in alternative embodiments, such as latches.

The upper and lower shells 108, 110 may be substantially identical to one another, representing mirrored halves. However, the upper and lower shells 108, 110 may be different from one another in other embodiments. The upper shell 110 includes a top 136 having a latch chamber 138. The latching assembly 200 is received in the latch chamber 138. A portion of the latching assembly 200 extends from the front of the latch chamber 138. A portion of the latching assembly 200 extends from the rear of the latch chamber 138.

Both shells 108, 110 include exterior shield walls 140. When multiple plug chambers 120 are provided, the shells 108, 110 also include interior shield walls 142 separating adjacent plug chambers 120. The interior shield walls 142 are formed integrally with the exterior shield walls 140. For example, the shells 108, 110 may be die-cast to form the exterior and interior shield walls 140, 142. The exterior and interior shield walls 140, 142 extend from a front 144 to a rear 146 of the plug chambers 120 to provide continuous shielding from the front 144 to the rear 146. The interior shield walls 142 provide shielding between adjacent plug chambers 120 in either shell 108, 110. The center plate 122 also defines an interior shield wall that provides shielding between upper plug chambers 120 and lower plug chambers 120. The exterior shield walls 140 include channels 148 the receive protrusions 150 extending from the plugs 106. The channels 148 align the plugs 106 with respect to the shielded housing 104 and hold the plugs 106 in position within the plug chambers 120.

In the illustrated embodiment, the shielded housing 104 includes four plug chambers 120 arranged in quadrants. The interior shield walls 142 and the center plate 122, which also defines an interior shield wall, shield adjacent plug chambers 120 from one another. The exterior shield walls 140 and the interior shield walls 142 surround the periphery of the plug chambers 120. Each plug chamber 120 is bounded on two sides by exterior shield walls 140 and each plug chamber 120 is bounded on two sides by interior shield walls 142. Four plugs 106 are received in the four plug chambers 120. The connector assembly 100 thus defines a quad connector assembly 100. The cable 26 has wires that are terminated to each of the plugs 106 in the different quadrants of the shielded housing 104. As such, the connector assembly 100 includes a single cable 26 with four discrete plugs 106 arranged in quadrants. Additionally, as described in further detail below, each of the plugs 106 represents a quad-type plug having the individual terminals 102 arranged as pairs in quadrants of the plug 106.

Figure 7:
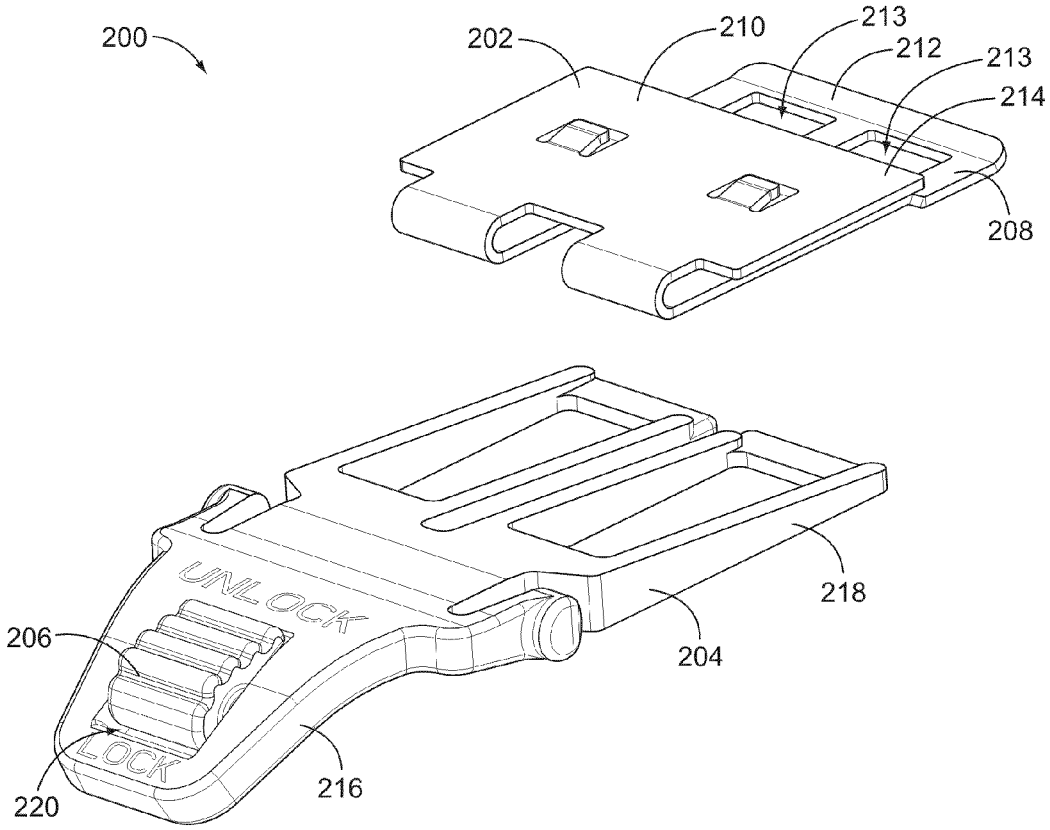
FIG. 7 is an exploded view of a latch assembly for the connector assembly shown in FIG. 5.

FIG. 7 is an exploded view of the latch assembly 200 for the connector assembly 100 (shown in FIG. 5). The latch assembly 200 includes a spring latch 202, a lever arm 204 and a lever lock 206.

The spring latch 202 is configured to engage the electrical connector 18 (shown in FIGS. 1-3) to secure the connector assembly 100 to the electrical connector 18. The spring latch 202 is movable between a latched position and an unlatched position. The spring latch 202 secures the connector assembly 100 to the electrical connector 18 when in the latched position. The connector assembly 100 is configured to be removed from the electrical connector 18 when the spring latch 202 is in the unlatched position.

The spring latch 202 is manufactured from a metal material, such as a stainless steel material. In the illustrated embodiment, the spring latch 202 has a generally U-shape with a first leg 208 and a second leg 210. The first leg 208 includes a latching end 212 that is configured to engage the electrical connector 18. In an exemplary embodiment, the latching end 212 includes a pair of openings 213 therein that receive the catches 37 (shown in FIG. 2) of the electrical connector 18. The interaction between the catches 37 and the openings 213 secures the spring latch 202 to the electrical connector 18. The second leg 210 includes a mounting end 214 that is configured to engage the shielded housing 104 (shown in FIGS. 5 and 6). The spring latch 202 is configured to electrically connect the electrical connector 18 and the shielded housing 104 to electrically common the components. The spring latch 202 defines a ground path between the electrical connector 18 and the shielded housing 104.

The lever arm 204 engages the spring latch 202 and is actuated to move the spring latch 202 to an unlatched position. The lever arm 204 includes a handle 216 at one end and one or more finger(s) 218 at the other end. The handle 216 is manipulated by the operator to actuate the lever arm 204. The fingers 218 engage the spring latch 202 to move the spring latch 202. The lever arm 204 includes a pocket 220 in the handle 216. The pocket 220 receives the lever lock 206. The lever lock 206 is movable within the pocket 220 between a locked position and an unlocked position. The lever lock 206 locks the lever arm 204 in place relative to the spring latch 202 in the locked position. The lever arm 204 is movable when the lever lock 206 is in the unlocked position to allow the lever arm 204 to move the spring latch 202 to the unlatched position.

Figure 8:
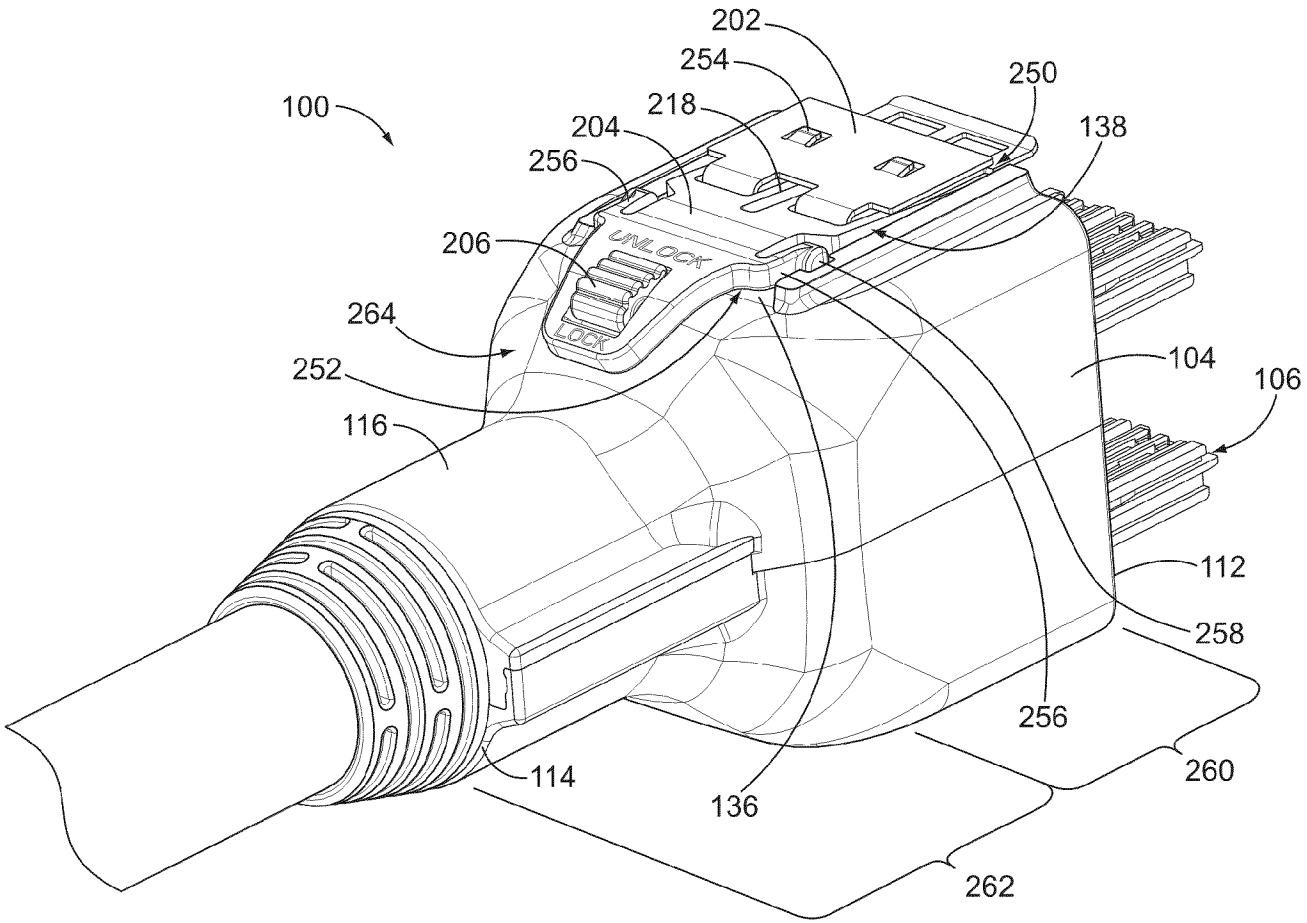
FIG. 8 is a partial cut-away view of the connector assembly illustrating the latch assembly coupled to the connector assembly.

FIG. 8 is a partial cut-away view of the connector assembly illustrating the latch assembly 200 coupled to the connector assembly 100. A portion of the shielded housing 104 is cut-away exposing the latch chamber 138. The latch assembly 200 is loaded into the latch chamber 138 and held therein by the shielded housing 104. The latch chamber 138 includes an open front 250 and an open back 252. The latch assembly 200 is relatively long, being exposed forward of the front 250 and rearward of the back 252, which positions the latch assembly 200 for actuation.

In an exemplary embodiment, the spring latch 202 is loaded into the latch chamber 138 through the open front 250, while the lever arm 204 is loaded into the latch chamber 138 through the open back 252. The spring latch 202 includes one or more tabs 254 extending from the second leg 210 that are received in corresponding openings (not shown) in the shielded housing 104 to secure the spring latch 202 within the latch chamber 138. The lever arm 204 includes a pair of pivot arms 256 that are received in openings 258 in the shielded housing 104. The pivot arms 256 secure the lever arm 204 within the latch chamber 138. The lever arm 204 may be pivoted about the pivot arms 256 to actuate the latch assembly 200.

The shielded housing 104 includes a generally box-shaped front section 260 that holds the plugs 106. The front section 260 is defined by four sides. The side of the shielded housing 104 defining the top 136 is generally planar, and the latch chamber 138 is arranged at the top 136. The top 136 is substantially perpendicular to the mating end 112. The shielded housing 104 includes a transition section 262 extending between the top 136 and the cable end 114. The transition section 262 is recessed below the top 136 and is angled away from the top 136. The transition section 262 includes the boss 116 at the cable end 114, and a back 264 extending between the boss 116 and the top 136. The back 264 is non-parallel to the top 136 and is angled downward from the top 136 to the boss 116. The back 264 merges into the boss 116 and the back 264 merges into the top 136. Optionally, the back 264 may be substantially perpendicular to the top 136 and/or the boss 116. The boss 116 has a smaller vertical cross-section than the front section 260, and the back 264 is used to transition between the boss 116 and the front section 260. The transitioning allows the back 264 to be rear facing and the back 264 is exposed from the rear of the connector assembly 100.

The lever arm 204 extends rearward from the latch chamber 138 and is exposed at the cable end 114 for actuation. For example, in the illustrated embodiment, the lever arm 204 is angled downward and generally follows the back 264 of the transition section 262. As such, the lever arm 204 is exposed along the back 264 of the transition section 262 and can be accessed from behind the cable end 114. The lever arm 204 can be accessed from a direction that is generally rearward of the lever arm 204 in addition to from above the lever arm 204. As such, if another connector assembly 100 were positioned vertically above the connector assembly 100, such as in a stacked configuration, the lever arm 204 could be accessed from behind the lever arm 204 rather than from above the lever arm 204, such as when access from above is blocked or hindered by the connector assembly 100 stacked above. By having the latch arm 204 contoured to follow the back 264, the latch arm 204 is exposed from the rear of the connector assembly 100.

Figure 9:
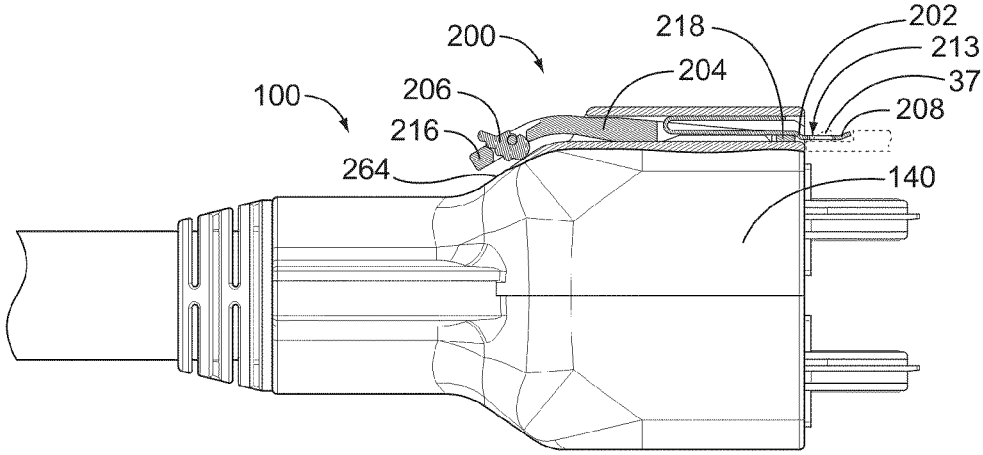
FIG. 9 is a partial cross-sectional view of the connector assembly with the latch assembly in a locked position.
Figure 10:
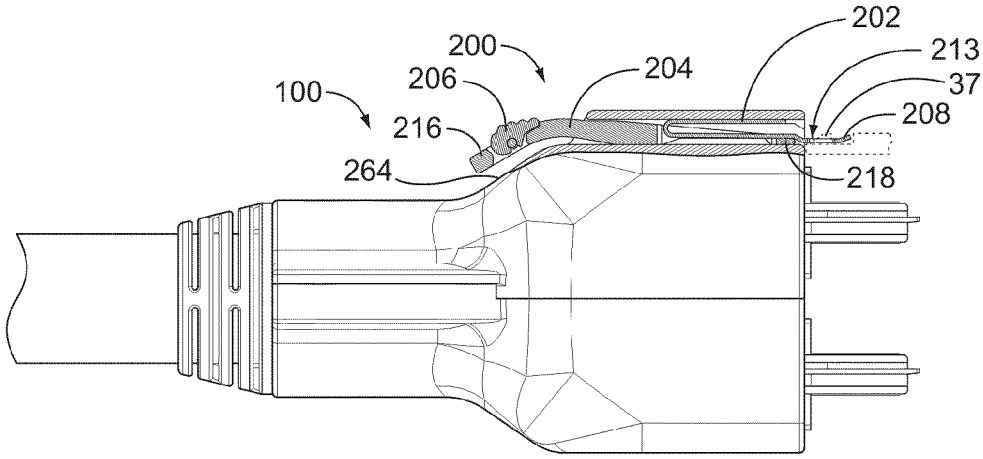
FIG. 10 is a partial cross-sectional view of the connector assembly with the latch assembly in an unlocked, latched position.
Figure 11:
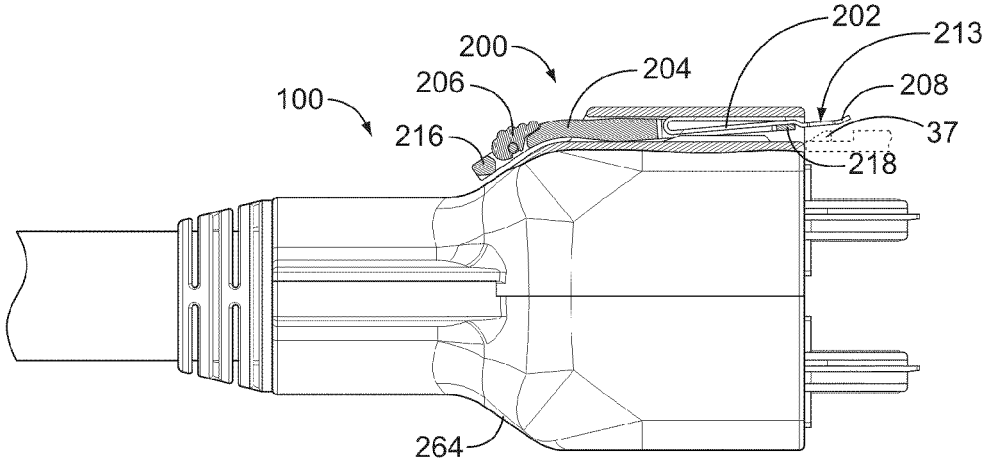
FIG. 11 is a partial cross-sectional view of the connector assembly with the latch assembly in an unlatched position.

FIG. 9 is a partial cross-sectional view of the connector assembly 100 with the latch assembly 200 in a locked position. FIG. 10 is a partial cross-sectional view of the connector assembly 100 with the latch assembly 200 in an unlocked, latched position. FIG. 11 is a partial cross-sectional view of the connector assembly 100 with the latch assembly 200 in an unlatched position.

The lever lock 206 is movable between a locked position (shown in FIG. 9) and an unlocked position (shown in FIGS. 10 and 11). Optionally, the lever lock 206 may be rotatably coupled to the handle 216, such that the lever lock 206 is rotated between the locked and unlocked positions. Other types of movements are possible, such as translational movements or compressive movements. In the locked position, the lever lock 206 locks the lever arm 204 in place relative to the spring latch 202 and the shielded housing 104. The handle 216 is held in place relative to the back 264 and is spaced apart from the back 264. When the lever lock 206 is in the locked position, the lever lock 206 extends from the handle 216 and engages the shielded housing 104 to block the handle 216 from moving toward the shielded housing 104.

When the lever lock 206 is in the unlocked position, the lever lock 206 is spaced apart from the shielded housing 104 such that the handle 216 is free to move toward the shielded housing 104 to actuate the spring latch 202.

During operation, once unlocked, the lever arm 204 and the spring latch 202 are in a latched position (shown in FIG. 10). In the latched position, the openings 213 in the latching end 212 receive the catches 37 of the electrical connector 18. The interaction between the catches 37 and the openings 213 secures the spring latch 202 to the electrical connector 18, and resists rearward movement of the connector assembly 100. In the latched position, the handle 216 is held away from the back 264 such that a gap still exists therebetween.

During actuation of the latch assembly 200, the handle 216 is pushed by a user toward the back 264, thus moving the lever arm 204 and the spring latch 202 to the unlatched position (shown in FIG. 11). For example, the fingers 218 are pivoted upward, thus lifting the end of the first leg 208. In the unlatched position, the catch 37 is no longer held within the opening 213. Rather, the fingers 218 clear the catch 37. The connector assembly 100 is free to move rearward.

When the handle 216 is released, the spring force of the spring latch 202 forces the spring latch 202 to return to the latched position, which also forces the lever arm 204 to the latched position. Thus, the lever arm 204 is automatically returned to the latched position. When the connector assembly 100 is mated with the electrical connector 18, the latch assembly 200 need not be actuated. Rather, the spring latch 202 may automatically clear the catch 37 and spring into the latched position without having to move the handle 216 to the unlatched position.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the invention without departing from its scope. Dimensions, types of materials, orientations of the various components, and the number and positions of the various components described herein are intended to define parameters of certain embodiments, and are by no means limiting and are merely exemplary embodiments. Many other embodiments and modifications within the spirit and scope of the claims will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means—plus-function format and are not intended to be interpreted based on 35 U.S.C. §112, sixth paragraph, unless and until such claim limitations expressly use the phrase "means for" followed by a statement of function void of further structure.

What is claimed is:

1. A connector assembly for mating with a multi-port electrical connector, the connector assembly comprising:

a shielded housing having a plurality of discrete shielded plug chambers, the shielded housing having a mating end and a cable end, the shielded housing having sides extending between the mating end and the cable end, at least one of the sides defining a back that is rear facing;

a plurality of plugs received in corresponding plug chambers, each of the plugs being shielded from one another by the shielded housing, the plugs being configured for simultaneous mating with the multi-port electrical connector, wherein each plug is received in a different port of the electrical connector; and a latch assembly coupled to the shielded housing, the latch assembly including a metal spring latch engaging the shielded housing, the metal spring latch of the latch assembly being configured to engage the multi-port electrical connector to define a ground path between the shielded housing and the multi-port electrical connector to electrically common the shielded housing and the multi-port electrical connector, the latch assembly having a lever arm engaging the metal spring latch, the lever arm being actuated to move the spring latch to an unlatched position, the lever arm being exposed along the back for actuation of the lever arm.

2. The connector assembly of claim 1, wherein the latch assembly is spring biased into contact with the shielded housing and the latch assembly is configured to be spring biased against the multi-port electrical connector.

3. The connector assembly of claim 1, wherein the shielded housing includes a mating end and a cable end, the spring latch extending from the mating end to engage the electrical connector to secure the connector assembly to the electrical connector when the spring latch is in a latched position, the lever arm being exposed at the cable end of the shielded housing.

4. The connector assembly of claim 1, wherein the shielded housing includes a mating end and a cable end, the shielded housing including a top between the mating end and the cable end, the shielded housing having a transition section extending between the top and the cable end, the transition section defining at least a portion of the back, the transition section being recessed below the top and angled away from the top, the spring latch provided at the top and the lever arm exposed along the transition section.

5. The connector assembly of claim 1, wherein the shielded housing includes a mating end and a cable end, the shielded housing including a top between the mating end and the cable end, the shielded housing having a cable boss at the cable end that receives the cable, the back extending between the top and the cable boss, the back being angled non-parallel to the top such that the back is rear facing, the spring latch provided at the top.

6. The connector assembly of claim 1, wherein the latch arm includes a lever lock movable between a locked position and an unlocked position, the lever lock locking the lever arm in place relative to the spring latch in the locked position, the lever arm being movable when the lever lock is in the unlocked position to allow the lever arm to move the spring latch to the unlatched position.

7. The connector assembly of claim 1, further comprising a multi-pair cable having multiple pairs of wires, the wires being terminated to corresponding terminals of each of the plugs in the different quadrants of the shielded housing.

8. The connector assembly of claim 1, wherein each shielded plug chamber is bounded on two sides by interior shield walls and each shielded plug chamber is bounded on two sides by exterior shield walls.

9. The connector assembly of claim 1, wherein the shielded plug chambers are arranged in quadrants, the shielded housing having interior shield walls and exterior shield walls surrounding the periphery of the plug chambers, and wherein each of the plurality of plugs have a plug insert with shield members defining plug quadrants, each of the plurality of plugs having a plurality of terminals held by the plug insert, the plurality of terminals being arranged in pairs in each of the plug quadrants.

10. A connector assembly for mating with a multi-port electrical connector, the connector assembly comprising:

a shielded housing having a plurality of discrete shielded plug chambers, the shielded housing having a mating end and a cable end, the shielded housing having sides extending between the mating end and the cable end, at least one of the sides defining a back that is rear facing;

a plurality of plugs received in corresponding plug chambers, each of the plugs being shielded from one another by the shielded housing, the plugs being configured for simultaneous mating with the multi-port electrical connector, wherein each plug is received in a different port of the electrical connector; and a latch assembly arranged along at least one of the sides of the shielded housing, the latch assembly having a spring latch configured to engage the electrical connector to secure the connector assembly to the electrical connector when the spring latch is in a latched position, the latch assembly having a lever arm engaging the spring latch, the lever arm being actuated to move the spring latch to an unlatched position, the lever arm being exposed along the back for actuation of the lever arm.

11. The connector assembly of claim 10, wherein the spring latch is metal, the spring latch engaging the electrical connector and the shielded housing to define a ground path therebetween.

12. The connector assembly of claim 10, wherein the shielded housing includes a transition section extending between the side having the latch assembly and the cable end, the transition section including the back, the transition section being recessed below the top and angled away from the top, the lever arm being exposed along the transition section.

13. The connector assembly of claim 10, wherein the shielded housing includes a cable boss at the cable end that receives the cable, the back extending between the cable boss and the side having the latch assembly, the back being angled non-parallel to the side having the latch assembly such that the back is rear facing, the lever arm being exposed along the back.

14. The connector assembly of claim 10, wherein the lever arm includes pivot arms extending therefrom, the pivot arms being pivotably coupled to the shielded housing to allow the lever arm to pivot, the lever arm includes a handle being pushed toward the back to actuate the lever arm and spring latch to the unlatched position.

15. The connector assembly of claim 10, wherein the spring latch is U-shaped defined by a first leg and a second leg, the first leg being held against the shield housing, the second leg being movable between a latched position and an unlatched position, the lever arm engaging the second leg to move the second leg to the unlatched position.

16. The connector assembly of claim 10, wherein the lever arm includes at least one finger extending therefrom, the at least one finger engaging the spring latch to actuate the spring latch.

17. The connector assembly of claim 10, wherein the shielded housing includes a latch chamber along one of the sides, the latch chamber having an open front and an open back, the latch assembly being received in the latch chamber with the spring latch being loaded into the latch chamber through the open front and with the lever arm being loaded into the latch chamber through the open back.

18. A connector assembly for mating with a multi-port electrical connector, the connector assembly comprising:

a shielded housing having a plurality of discrete shielded plug chambers;

a plurality of plugs received in corresponding plug chambers, each of the plugs being shielded from one another by the shielded housing, the plugs being configured for simultaneous mating with the multi-port electrical connector, wherein each plug is received in a different port of the electrical connector; and a latch assembly arranged along at least one of the sides of the shielded housing, the latch assembly having a spring latch configured to engage the electrical connector to secure the connector assembly to the electrical connector when the spring latch is in a latched position, the latch assembly having a lever arm engaging the spring latch, the lever arm being actuated to move the spring latch to an unlatched position, the latch assembly having a lever lock movably coupled to the lever arm, the lever lock being movable between a locked position and an unlocked position, the lever lock locking the lever arm in place relative to the spring latch in the locked position, the lever arm being movable when the lever lock is in the unlocked position to allow the lever arm to move the spring latch to the unlatched position.

19. The connector assembly of claim 18, wherein the lever arm includes a handle held spaced apart from the shielded housing, the lever lock being held by the handle, when in the locked position, the lever lock extends from the handle and engages the shielded housing to block the handle from moving toward the shielded housing, when in the unlocked position, the lever lock is spaced apart from the shielded housing such that the handle is free to move toward the shielded housing to actuate the spring latch.

20. The connector assembly of claim 18, wherein the lever arm extends between a first end and a second end, the first end engaging the spring latch, the second end extending along one of the sides of the shielded housing and being normally held spaced apart from the shielded housing, the second end being movable to move the spring latch to the unlatched position, the lever lock locks the lever arm in place when the lever lock is in the locked position, the lever arm being capable of moving when the lever lock is in the unlocked position.

21. The connector assembly of claim 18, wherein the lever arm extends between a first end and a second end, the lever arm includes pivot arms intermediate between the first and second ends, the lever arm being pivotable to actuate the spring latch, the lever lock being rotatably coupled to the lever arm to move between the locked position and the unlocked position.

22. The connector assembly of claim 10, wherein the lever arm is actuated by pressing the lever arm in a direction toward the back to move the spring latch from the latched position to an unlatched position.

23. The connector assembly of claim 10, wherein at least one of the sides defines a top of the shielded housing, the lever arm being exposed along the back below the top of the shielded housing.

* * * * *